United States Patent [19]

Ozaki et al.

[11] Patent Number: 5,036,123

[45] Date of Patent: Jul. 30, 1991

[54] STRAIGHT OIL COMPOSITION FOR FIBROUS MATERIAL

[75] Inventors: Masaru Ozaki; Isao Ona, both of Chiba, Japan

[73] Assignee: Toray Silicon Company, Limited, Tokyo, Japan

[21] Appl. No.: 426,908

[22] Filed: Oct. 24, 1989

[30] Foreign Application Priority Data

Nov. 4, 1988 [JP] Japan ..... 63-278740

[51] Int. Cl.[5] ..... C08K 5/54

[52] U.S. Cl. ..... 524/267; 524/265; 106/287.14; 106/287.1

[58] Field of Search ..... 524/265, 267; 106/287.14, 287.1

[56] References Cited

U.S. PATENT DOCUMENTS 4,743,648 5/1988 Hill et al. ..... 106/287.14
4,886,551 12/1989 Fink et al. ..... 524/267

FOREIGN PATENT DOCUMENTS 42-8438 4/1967 Japan .
48-19893 3/1973 Japan .
53-81798 7/1978 Japan .
63-8233 2/1988 Japan .

*Primary Examiner*—Melvyn I. Marquis
*Attorney, Agent, or Firm*—George A. Grindahl

[57] ABSTRACT

Straight oil compositions for fibrous materials, which provide excellent smoothness and antistatic properties and also have excellent spearation resistance, even without compatibilizers, comprise (A) 100 parts by weight of dimethyl polysiloxane having a viscosity of from 3 to 30 cSt at 25° C. and (B) 0.5 to 50 parts by weight of a polyoxyalkylene group-terminated organopolysiloxane. The polyoxyalkylene groups of Component (B) have a block structure of polyoxypropylene and polyoxyethylene units, with the former being bonded to the siloxane moiety. Component (A) is preferably a trimethylsiloxy-terminated polydimethylsiloxane.

6 Claims, No Drawings

STRAIGHT OIL COMPOSITION FOR FIBROUS MATERIAL

BACKGROUND OF THE INVENTION

The present invention concerns straight oil compositions for fibrous materials. Conventionally, for excellence in heat resistance, lubricity, etc., dimethyl polysiloxane oils have been used widely as straight oils such as spandex oils and sewing machine thread oils. The term "straight oil" means 100% oil treatment agents free from solvent or water.

Recently, for improving smoothness and antistatic properties of dimethyl polysiloxane oils, various improved straight oils have been developed. Examples include mixtures of ethylene oxide- and propylene oxide-based polyoxyalkylene-modified silicones, smoothing agents of viscosity below 100 cSt (centistokes), and higher alcohols, as disclosed in Japanese Kokai Patent No. Sho 48(1973)-19893; mixtures of dimethyl polysiloxane oils of viscosity 3–50 cSt and an alpha TM olefin polyether-modified oil as disclosed in Japanese Kokoku Patent No. Sho 53(1978)-81798; mixtures of mineral oil and/or polydiorganosiloxane and amino-modified silicone oil as disclosed in Japanese Kokoku Patent No. Sho 63(1988)-8233; and mixtures of polydimethylsiloxane and polyamylsiloxane as disclosed in Japanese Kokoku Patent No. 42(1967)-8438.

However, conventional oxyalkylene-modified silicones use polyoxyalkylenes that are random copolymers of ethylene oxide and propylene oxide, thus compatibility with the base oil, dimethyl polysiloxane oil is extremely poor, and use of compatibilizers such as higher alcohols and their fatty acid esters is required. However, even with such compatibilizers, there is a limit in solubilizing power. Namely, complete compatibility is not possible, and separation occurs with the elapse of time.

With more of such compatibilizers used, the lubricity of dimethyl polysiloxane oils and the antistatic properties of the polyoxyalkylene-modified silicone oils decrease, thus development of straight oils requiring no compatibilizers is desired.

The amino-modified silicones and amylsiloxanes are not sufficient in antistatic properties, and they yellow fibrous materials.

BRIEF SUMMARY OF THE INVENTION

It is an object of the present invention to provide straight oil compositions for fibrous materials, which have excellent smoothness and antistatic properties and also excellent separation resistance even without compatibilizers.

The above object can be achieved by a straight oil composition for fibrous materials comprising:

(A) 100 parts by weight of dimethyl polysiloxane having a viscosity of from 3 to 30 cSt at 25° C. and (B) 0.5 to 50 parts by weight of a polyoxyalkylene group-containing organopolysiloxane represented by the general formula $Q\{(CH_3)_2SiO\}Si(CH_3)_2Q$, wherein x is an integer of one or more and each Q represents, independently, a polyoxyalkylene group having the formula $—RO(C_3H_6O)_a(C_2H_4O)_bR^1$ wherein R represents an alkylene group having from 2 to 5 carbon atoms; $R^1$ represents a radical selected from the group consisting of the hydrogen atom, alkyl groups having from 1 to 6 carbon atoms, $—COCH_3$, and $—COR^2COOH$; $R^2$, represents a divalent hydrocarbon group having from 1 to 15 carbon atoms; $(C_3H_6O)_a$ and $(C_2H_4O)_b$ represent oxyalkylene blocks and these oxyalkylene blocks are connected as shown in the formula Q; a is an integer of 1–15; b is an integer of 1–15; and the a/b ratio is 1/10 to 10/1.

The dimethyl polysiloxane used as component (A) has a viscosity of 3–30 cSt at 25° C. and provides lubrication to the fibrous materials. With viscosity below 3 cSt, the lubrication is not sufficient, while above 30 cSt, too much dimethyl polysiloxane adheres to the fibrous materials. The molecular structure may be linear, cyclic, or partially branched and consists of dimethyl siloxane units and, in the case of linear structures, trimethylsiloxy or hydroxy end groups and, additionally, in the case of partially branched structures trace amounts of methyl siloxane units and silica units.

Dimethyl polysiloxanes are well known in the organosilicon art and need no further delineation herein. Many, including the cyclic and linear compounds, are commercially available. A preferred dimethyl polysiloxane is a linear trimethylsiloxy-terminated polydimethylsiloxane.

The polyoxyalkylene group-containing organopolysiloxanes used as component (B) are the components that effect the characteristics of the present invention, i.e., they are compatible with component (A) and impart good antistatic properties to the fibrous materials. They are represented by the general formula $Q(CH_3)_2SiO\}_xSi(CH_3)_2Q$ where the subscript x is an integer of at least one and Q represents a polyoxyalkylene group.

In the formula immediately above the maximum value of x is not narrowly restricted; it has been found that excellent results have been obtained with polyoxyalkylene group-containing organopolysiloxanes wherein the average value of x is as large as 100.

In the formula immediately above Q represents a polyoxyalkylene having the formula $—RO(C_3H_6O)_a(C_2H_4O)_bR^1$. In the formula for Q, R represents an alkylene group having from 2 to 5 carbon atoms; $R^1$ represents a hydrogen atom, an alkyl group having from 1 to 6 carbon atoms, $—COCH_3$, or $—COR^2COOH$; $R^2$ represents a divalent hydrocarbon group having from 1 to 15 carbon atoms; $(C_3H_6O)_a$ and $(C_2H_4O)_b$ are blocks, and these oxyalkylene blocks are connected as shown in the formula Q; the subscript a is an integer of 1–15 preferably 3–10; the subscript b is an integer of 1–15 preferably 3–10; the a/b ratio is 1/10 to 10/1, preferably 3/10 to 10/3.

The alkylene group of 2–5 carbon atoms for R may be an ethylene group, propylene group, butylene group, isobutylene group, pentylene group, etc.

$R^1$ represents a hydrogen atom, an alkyl group of 1–6 carbon atoms, $—COCH_3$, or $—COR_2COOH$. The alkyl group of 1–6 carbon atoms for $R^1$ may be a methyl, ethyl, propyl, isopropyl, n-butyl, isobutyl, n-pentyl, etc. $R^2$ represents a divalent hydrocarbon group of 1–15 carbon atoms such as an alkylene group, e.g., an ethylene group, a propylene group, etc.; alkenylene group, e.g., a vinylene group, a propenylene group, etc.; an arylene group, e.g. a phenylene group, etc.; or a divalent group having the following formula.

$$—CH_2\underset{\displaystyle |}{C}H\underset{\displaystyle |}{C}H—CH{=}CHC_8H_{17}$$
$$\qquad\qquad\quad CH_3$$

The preferred $R^1$ is a hydrogen atom, a methyl group or an acetoxy group.

The propylene oxide units of the polyoxalkylene group Q in the polyoxyalkylene-group-containing organopolysiloxanes of the present invention are located as a block at the organopolysiloxane, i.e. internal, side of the Q radical and the ethylene oxide units are located as a block on the opposite, i.e. terminal, side, of the Q radical.

According to our study, it has been learned that such polyoxyalkylene group structure is useful for enhancing the compatibility with dimethyl polysiloxane.

The amount of this component (B) used, based on 100 parts by weight of the component (A), is 0.5–50 parts by weight, preferably 3–10 parts by weight, and for heavy antistatic effects, 5–20 parts by weight.

The polyoxyalkylene group-containing organopolysiloxanes can be prepared by any suitable method that will provide a block structure. For example, a desired number of moles of propylene oxide is first added to an unsaturated alcohol, such as allyl alcohol, followed by adding a desired number of moles of ethylene oxide to obtain an unsaturated-group-containing polyoxyalkylene. Next, this product is subjected to an addition reaction with an organohydrogenpolysiloxane containing silicon-bonded hydrogen atoms at its terminal portions in the presence of a platinum catalyst to synthesize the organopolysiloxane of this component.

The compositions of the present invention can be prepared by simple mixing of components comprising components (A) and (B) to provide a transparent liquid with good compatibility of components (A) and (B).

Within the scope of the present invention, the compositions of the present invention may be compounded with other additives, such as anticorrosive agents, and organopolysiloxanes other than components (A) and (B).

In treating fibrous materials, the fibrous materials may be immersed in a treatment bath of the composition of the present invention followed by squeezing with rollers, or fibrous materials are run through the bath and contacted by a pickup roll, or the compositions are sprayed on the fibrous materials. The amount applied varies depending on the fibrous materials, and thus is not restricted in any particular way. It is usually 0.05–7.0 wt%, preferably 0.5–5.0% as organopolysiloxane, based on the fibrous material. After application, heat treatment gives uniformity.

The fibrous materials may be natural fibers such as wool, silk, jute, cotton, angora, mohair, etc.; regenerated fibers such as viscose rayon, cuprammonium rayon, etc.; semisynthetic fibers such as acetate, etc.; synthetic fibers such as polyesters, polyamides, polyacrylonitrile, poly(vinyl chloride), poly(vinyl alcohol), polyethylene, polypropylene, spandex, etc.

Next, the present invention is explained with examples. Unless stated otherwise, parts are by weight, and percentages are by weight. Viscosity values are at 25° C.

The following ten organopolysiloxanes are synthesized.

A. Invention Compound $HOC_2H_4OC_2H_4OC_2H_4OC_2H_4OC_2H_4—OC_3H_6OC_3H_6OC_3H_6OC_3H_6—OC_3H_6—\{(CH_3)_2SiO\}_{100}(CH_3)_2Si—C_3H_6O—C_3H_6OC_3H_6OC_3H_6OC_3H_6OC_3H_6O—C_2H_4OC_2H_4OC_2H_4OC_2H_4OC_2H_4OH$ Viscosity: 748 cSt.

B. Invention Compound $HOC_2H_4OC_2H_4OC_2H_4OC_2H_4OC_2H_4—OC_3H_6OC_3H_6OC_3H_6OC_3H_6—OC_3H_6—\{(CH_3)_2SiO\}_{90}(CH_3)_2Si—C_3H_6O—C_3H_6OC_3H_6OC_3H_6OC_3H_6OC_3H_6O—C_2H_4OC_2H_4OC_2H_4OC_2H_4OC_2H_4OH$ Viscosity: 678 cSt.

C. Invention Compound $HOCO(CH_2)_2COOC_2H_4OC_2H_4OC_2H_4OC_2H_4OC_2H_4—OC_3H_6OC_3H_6OC_3H_6OC_3H_6—OC_3H_6—\{(CH_3)_2SiO\}_{90}(CH_3)_2Si—C_3H_6O—C_3H_6OC_3H_6OC_3H_6OC_3H_6OC_3H_6O—C_2H_4OC_2H_4OC_2H_4OC_2H_4OC_2H_4OCO(CH_2)_2COOH$ Viscosity 2110 cSt.

D. Invention Compound $HOCO(CH_2)_2COOC_2H_4OC_2H_4OC_2H_4OC_2H_4OC_2H_4—OC_3H_6OC_3H_6OC_3H_6OC_3H_6—OC_3H_6—\{(CH_3)_2SiO\}_{60}(CH_3)_2Si—C_3H_6O—C_3H_6OC_3H_6OC_3H_6OC_3H_6OC_3H_6O—C_2H_4OC_2H_4OC_2H_4OC_2H_4OC_2H_4OCO(CH_2)_2COOH$ Viscosity: 1521 cSt.

E. Comparison Compound $H(PC_3H_6)_5(OC_2H_4)_4—OC_3H_6—\{(CH_3)_2SiO\}_{100}(CH_3)_2Si—C_3H_6O—(C_2H_4O)_5(C_3H_6O)_5H$ Viscosity: 536 cSt. (ethylene oxide random copolymer)

F. Comparison Compound $H(OC_2H_4)_{12}—OC_3H_6—\{(CH_3)_2SiO\}_{100}(CH_3)_2Si-C_3H_6O—(C_2H_4O)_{12}H$ Viscosity; 3820 cSt.

G. Comparison Compound $H(OC_2H_4)_5—OC_3H_6—\{(CH_3)_2SiO\}_{100}(CH_3)_2Si—C_3H_6O—(C_2H_4O)_5H$ Viscosity: 284 cSt.

H. Comparison Compound $(CH_3)_3Si\{(CH_3)_2Si-O_{400}\{(CH_3)(NH_2CH_2CH_2NHC_3H_6)SiO\}_8Si(CH_3)_3$ Viscosity: 1200 cSt.

I. Comparison Compound

Partial hydrolytic condensate of $C_4H_9Si(OCH_3)_3$
Viscosity: 23000 cSt.

J. Comparison Compound $HOC_3H_6OC_3H_6OC_3H_6OC_3H_6OC_3H_6—OC_2H_4OC_2H_4OC_2H_4OC_2H_4—OC_3H_6—$ $\{(CH_3)_2SiO\}_{100}(CH_3)_2Si—C_3H_6O—C_2H_4OC_2H_4OC_2H_4OC_2H_4OC_2H_4O—$ $C_3H_6OC_3H_6OC_3H_6OC_3H_6OC_3H_6OH$ Viscosity: 425 cSt.

APPLICATION EXAMPLE 1

Dimethyl polysiloxane terminated by trimethylsiloxy groups at both chain ends (Silicone was compounded with the organopolysiloxanes A-J (Polyoxyalkylenesiloxane) above, as described in Table 1, mixed for 15 minutes to obtain treatment liquids for spandex fibers. The dimethyl polysiloxane used had a viscosity of 10 cSt or 20 cSt.

TABLE I

| Treatment Liquid No. | Composition, parts: Silicone 10 cSt. | Silicone 20 Sts. | Polyoxyalkylenesiloxane A | B | C | D | E | F | G | H | I | J |
|---|---|---|---|---|---|---|---|---|---|---|---|---|
| Invention 1 | 100 | | 1 | | | | | | | | | |
| Invention 2 | 100 | | 3 | | | | | | | | | |
| Invention 3 | 100 | | 5 | | | | | | | | | |
| Invention 4 | 100 | | 10 | | | | | | | | | |
| Invention 4 | 100 | | 20 | | | | | | | | | |
| Invention 6 | | 100 | | 10 | | | | | | | | |
| Invention 7 | | 100 | | | 10 | | | | | | | |
| Invention 8 | | 100 | | | | 10 | | | | | | |
| Comparison 9 | 100 | | | | | | 5 | | | | | |
| Comparison 10 | 100 | | | | | | | 5 | | | | |
| Comparison 11 | 100 | | | | | | | | 5 | | | |
| Comparison 12 | 100 | | | | | | | | | 5 | | |
| Comparison 13 | 100 | | | | | | | | | | 5 | |
| Comparison 14 | 100 | | | | | | | | | | | 5 |
| Comparison 15 | 100 | | | | | | | | | | | |
| Comparison 16 | | 100 | | | | | | | | | | |

In glass bottles were placed 100 cc of each treatment liquid separately, they were allowed to stand at 25° C. for 1 week, and compatibility was evaluated by the standard below:

<a> = Uniform dissolution and dispersion, transparent.

<b> = Slightly turbid when compounded, some separation after 1 week.

<c> = Turbid when compounded, complete separation after 1 week.

Volume resistivity in compounding was measured according to JIS C21001, using a volume resistivity meter from the Hewlett Packard Co. of the U.S.A.

As shown in Table II, the treatment liquids of the present invention show good compatibility, uniform dispersion, and stability and low volume resistvity, and are thus very favorable as straight oils for spandex fibers.

TABLE II

| Treatment Liquid No. | Compatibility | Volume Resistivity, ohm · cm. | Overall Evaluation as Oils for Spandex Fibers |
|---|---|---|---|
| Invention 1 | <a> | $8.8 \times 10^{10}$ | Suitable |
| Invention 2 | <a> | $7.0 \times 10^{10}$ | Suitable |
| Invention 3 | <a> | $4.6 \times 10^{10}$ | Suitable |
| Invention 4 | <a> | $1.7 \times 10^{10}$ | Suitable |
| Invention 5 | <a> | $1.6 \times 10^{10}$ | Suitable |
| Invention 6 | <a> | $5.1 \times 10^{10}$ | Suitable |
| Invention 7 | <a> | $9.6 \times 10^{9}$ | Suitable |

TABLE II-continued

| Treatment Liquid No. | Compatibility | Volume Resistivity, ohm · cm. | Overall Evaluation as Oils for Spandex Fibers |
|---|---|---|---|
| Invention 8 | <a> | $7.2 \times 10^{9}$ | Suitable |
| Comparison 9 | <b>-<c> | $3.3 \times 10^{11}$ | Unsuitable* |
| Comparison 10 | <c> | $2.8 \times 10^{11}$ | Unsuitable** |
| Comparison 11 | <a> | $5.5 \times 10^{12}$ | Unsuitable*** |
| Comparison 12 | <a> | $3.3 \times 10^{13}$ | Unsuitable*** |
| Comparison 13 | <a> | $6.2 \times 10^{12}$ | Unsuitable*** |
| Comparison 14 | <b> | $3.8 \times 10^{11}$ | Unsuitable* |
| Comparison 15 | — | $6.6 \times 10^{14}$ | Unsuitable**** |
| Comparison 16 | — | $4.6 \times 10^{14}$ | Unsuitable**** |

*Insufficient compatibility.
**Poor compatibility.
***Insufficient antistatic properties.
****Poor antistatic properties.

APPLICATION EXAMPLE 2

A nylon sewing machine thread skein that had been woolie finished and fluorescent whitened was immersed in the treatment liquid of 3, 12, or 15 and adjusted to 5.5% pickup using a centrifugal dewatering machine.

Next, the treated machine thread was wound on 5 sheets of thick paper of 3 cm×5 cm×0.2 cm, and 4 sheets were fitted on a Todai Kaken-type rotary static tester and rubbed with 100% cotton shirting No. 3 at 800 rpm for 60 sec, then the triboelectric voltage was measured. One-half of the remaining sheet was covered with a black paper, irradiated in a fadeometer-type weather tester for 3 hr, and the yellowing caused by the light irradiation was evaluated according to JIS L0804 using a fading gray scale.

As shown in Table III, the samples treated with the treatment agents of the present invention had low triboelectric voltage and no yellowing, thus the treatment agents are suitable as lubricants for machine threads.

TABLE III

| Treatment Liquid No. | Triboelectric Voltage, volts | Yellowing Fadeometer Rating |
|---|---|---|
| Invention 3 | 870 | 4 |
| Comparison 12 | 1260 | 2 |

TABLE III-continued

| Treatment Liquid No. | Triboelectric Voltage, volts | Yellowing Fadeometer Rating |
|---|---|---|
| Comparison 15 | 1440 | 4 |
| Blank | 1780 | 4 |

APPLICATION EXAMPLE 3

Two organopolysiloxanes shown below were synthesized:

K. Invention Compound $H(OC_2H_4)_5(OC_3H_6)_{10}—OC_3H_6—\{(CH_3)_2SiO\}_{90}(CH_3)_2SiC—C_3H_6O—(C_3H_6O)_{10}(C_2H_4O)_5H$ (ethylene oxide-propylene oxide block copolymer) Viscosity: 1020 cSt.

L. Invention Compound $H(OC_2H_4)_5(OC_3H_6)_3—OC_3H_6—\{(CH_3)_2SiO\}_{90}(CH_3)_2Si—C_3H_6O—(C_3H_6O)_3(C_2H_4O)_5H$ (ethylene oxide-propylene oxide block copolymer) Viscosity: 584 cSt.

Treatment liquids for spandex fiber were prepared similarly to those in Application Example 1 by mixing 100 parts of dimethyl polysiloxane terminated by trimethylsiloxy groups at both chain ends and having a viscosity of 5 cSt and 10 parts of organopolysiloxanes prepared above and the liquids were evaluated. Results are given in Table IV. The results showed good compatibility and antistatic properties of the treatment liquids of the present invention.

TABLE IV

| Treatment Liquid No. | Composition, parts Silicone | K | L | Compatibility | Volume Resistivity ohm · cm. | Overall Spandex Rating |
|---|---|---|---|---|---|---|
| Invention 9 | 100 | 10 | — | <a> | $2.3 \times 10^{10}$ | Suitable |
| Invention 10 | 100 | — | 10 | <a> | $5.1 \times 10^{11}$ | Suitable |
| Comparison | 100 | — | — | — | $2.8 \times 10^{14}$ | * |

*Unsuitable due to poor antistatic properties.

APPLICATION EXAMPLE 4

Two organopolysiloxanes shown below were synthesized:

M. Invention Compound $CH_3(OC_2H_4)_5(OC_3H_6)_3—OC_3H_6—\{(CH_3)_2SiO\}_{90}(CH_3)_2Si—C_3H_6O—(C_3H_6O)_3(C_2H_4O)_5CH_3$ (ethylene oxide-propylene oxide block copolymer) Viscosity: 430 cSt.

N. Invention Compound $CH_3CO(OC_2H_4)_5(OC_3H_6)_{10}—OC_3H_6—\{(CH_3)_2SiO\}_{90}(CH_3)_2Si—C_3H_6O—(C_3H_6O)_{10}(C_2H_4O)_5COCH_3$ (ethylene oxide-propylene oxide block copolymer) Viscosity: 460 cSt.

Treatment liquids for spandex fiber were prepared similarly to those in Application Example 1 by mixing 100 parts of dimethyl polysiloxane, terminated by trimethylsiloxy groups at both chain ends and having a viscosity of 5 cSt, and 10 parts of prepared organopolysiloxanes M and N.

The results showed good compatibility and volume resistivity $8.5 \times 10^{11}$ ohm-cm (M) and $7.3 \times 10^{11}$ ohm-cm (N) indicating good antistatic properties. Thus these liquids are suitable as oils for spandex.

EFFECTS OF THE INVENTION

The straight oils of the present invention for fibrous materials are excellent in providing smoothness, antistatic properties, separation resistance, and yellowing resistance to a fibrous material treated therewith.

That which is claimed is:

1. A straight oil composition for fibrous materials comprising:

(A) 100 parts by weight of dimethyl polysiloxane having a viscosity of from 3 to 30 cSt at 25° C. and (B) 0.5 to 50 parts by weight of a polyoxyalkylene group-containing organopolysiloxane represented by the general formula $Q\{(CH_3)_2SiO\}_xSi(CH_3)_2Q$, wherein x is an integer of one or more and each Q represents, independently, a polyoxyalkylene group having the formula $—RO(C_3H_6O)_a(C_2H_4O)_bR^1$, wherein R represents an alkylene group having from 2 to 5 carbon atoms; $R^1$ represents a radical selected from the group consisting of the hydrogen atom, alkyl groups having from 1 to 6 carbon atoms, $—COCH_3$, and $—COR^2COOH$; $R^2$ represents a divalent hydrocarbon group having from 1 to 15 carbon atoms; $(C_3H_6O)_a$ and $(C_2H_4O)_b$ represent oxyalkylene blocks and these oxyalkylene blocks are connected as shown in the formula Q; a is an integer of 1–15; b is an integer of 1–15; and the a/b ratio is 1/10 to 10/1.

2. A straight oil composition for fibrous materials according to claim 1 wherein Component (A) is a trimethylsiloxy-terminated polydimethylsiloxane.

3. A straight oil composition for fibrous materials according to claim 2 wherein the subscripts a and b in Q, independently, have values of from 3 to 10; and the a/b ratio is 3/10 to 10/3.

4. A straight oil composition for fibrous materials according to claim 3 wherein each $R^1$ is independently selected from the group consisting of a hydrogen atom, a methyl group and an $COCH_3$ group.

5. A straight oil composition for fibrous materials according to claim 4 wherein the amount of component (B) used, based on 100 parts by weight of component (A), is from 3 to 10 parts by weight.

6. A straight oil composition for fibrous materials according to claim 4 wherein the amount of component (B) used, based on 100 parts by weight of component (A), is from 5 to 20 parts by weight.

* * * * *